US011673160B2

(12) United States Patent
Kuhn et al.

(10) Patent No.: US 11,673,160 B2
(45) Date of Patent: Jun. 13, 2023

(54) METHOD FOR OPERATING A DISPENSING SYSTEM AND DISPENSING SYSTEM

(71) Applicant: Hilti Aktiengesellschaft, Schaan (LI)

(72) Inventors: Martin Kuhn, Germering (DE); Christian Hefele, Breitenbrunn (DE)

(73) Assignee: Hilti Aktiengesellschaft, Schaan (LI)

( * ) Notice: Subject to any disclaimer, the term of this patent is extended or adjusted under 35 U.S.C. 154(b) by 85 days.

(21) Appl. No.: 17/298,722

(22) PCT Filed: Nov. 25, 2019

(86) PCT No.: PCT/EP2019/082355

§ 371 (c)(1),
(2) Date: Jun. 1, 2021

(87) PCT Pub. No.: WO2020/120112

PCT Pub. Date: Jun. 18, 2020

(65) Prior Publication Data

US 2022/0048064 A1 Feb. 17, 2022

(30) Foreign Application Priority Data

Dec. 14, 2018 (EP) ..... 18212571

(51) Int. Cl.
*B05C 17/01* (2006.01)
*B05C 17/005* (2006.01)

(52) U.S. Cl.
CPC .... *B05C 17/0103* (2013.01); *B05C 17/00553* (2013.01)

(58) Field of Classification Search
CPC ..... B05C 17/0103; B05C 17/00553
(Continued)

(56) References Cited

U.S. PATENT DOCUMENTS 5,556,009 A * 9/1996 Motzko ..... B05B 12/085 222/326
8,573,450 B2 * 11/2013 Hsu ..... B05C 17/0103 222/386

(Continued)

FOREIGN PATENT DOCUMENTS

DE 10 2011 075 873 11/2012
DE 10 2016 213 882 2/2018

OTHER PUBLICATIONS

International Search Report dated Feb. 19, 2020 in PCT/EP2019/082355, with English translation, 6 pages.

(Continued)

*Primary Examiner* — Lien M Ngo
(74) *Attorney, Agent, or Firm* — Grüneberg and Myers, PLLC

(57) ABSTRACT

A dispensing system includes a dispensing apparatus and a cartridge device. The dispensing apparatus has at least one receiving chamber for receiving the cartridge device, at least one dispensing device, a control device, a drive device and a power supply. The method includes inserting the cartridge device into the at least one receiving chamber; emitting at least one first signal from a signal generator of the cartridge device; receiving the at least one signal of the cartridge device by at least one sensor of the dispensing apparatus; transmitting a second signal from the sensor to the control device; transferring the drive device from a first operating mode into a second operating mode if the second signal corresponds to a value stored in the control device or if an algorithm stored in the control device verifies the second signal, or transferring the drive device into a third operating mode.

17 Claims, 3 Drawing Sheets

(58) Field of Classification Search
USPC ..... 222/135, 145.5, 63, 326, 333, 386, 1
See application file for complete search history.

(56) References Cited

U.S. PATENT DOCUMENTS

| | | | | |
|---|---|---|---|---|
| 8,807,394 | B2 * | 8/2014 | Broyles | A61C 5/64 222/137 |
| 8,957,608 | B2 * | 2/2015 | Hsu | H02P 7/03 222/251 |
| 9,358,572 | B2 * | 6/2016 | Grontved | B05C 17/00596 |
| 9,452,443 | B2 * | 9/2016 | Grontved | B05B 12/002 |
| 9,862,001 | B2 * | 1/2018 | Turner | B05C 17/012 |
| 10,189,698 | B2 * | 1/2019 | Proper | B67D 7/0288 |
| 10,265,721 | B2 * | 4/2019 | Beckett | B05C 17/0116 |
| 10,334,837 | B1 * | 7/2019 | Reid | A01M 25/006 |
| 2013/0075427 | A1 | 3/2013 | Christopher et al. | |
| 2014/0209630 | A1 | 7/2014 | O'Leary et al. | |
| 2018/0185117 | A1 | 7/2018 | Goerge et al. | |
| 2020/0001320 | A1 * | 1/2020 | Turner | H04B 1/02 |

OTHER PUBLICATIONS

Written Opinion dated Feb. 19, 2020 in PCT/EP2019/082355, with English translation, 10 pages.

* cited by examiner

METHOD FOR OPERATING A DISPENSING SYSTEM AND DISPENSING SYSTEM

CROSS-REFERENCE TO RELATED APPLICATIONS

This application is the National Stage entry under § 371 of International Application No. PCT/EP2019/082355 filed on Nov. 25, 2019, and which claims the benefit of European Application No. 18212571.6, filed on Dec. 14, 2018. The content of each of these applications is hereby incorporated by reference in its entirety.

BACKGROUND OF THE INVENTION

Field of the Invention

The invention relates to a method for operating a dispensing system according to an embodiment that comprises a dispensing apparatus and a cartridge device. The invention also relates to a dispensing system for carrying out a method of this kind according to the subject matter of the embodiments.

Description of Related Art

Dispensing apparatuses are used in the construction sector, for example, for dispensing silicone or other liquid or viscous construction materials from cartridge devices, Dispensing apparatuses which are designed to receive cartridge devices having two or more chambers are also known. Cartridge devices of this kind can contain, for example, a two-component mortar composition, a curable resin component being arranged in one chamber or cartridge of the cartridge device and a curing component being arranged in a further chamber or cartridge of the cartridge device that is arranged separately from the first chamber or cartridge in a reaction-inhibiting manner. Cartridge devices containing two-component mortar compositions of this kind are used, for example, as injection mortars for the chemical anchoring, for example, of metal elements in mineral substances, in particular structures made of brickwork, concrete or natural stone. In this case, the boreholes which are correspondingly required for fastening the anchoring means are first introduced into the mineral substrate, after which the curable resin component is mixed with the curing component of the two-component mortar composition and introduced into the borehole, whereupon the anchoring means to be fastened is inserted and adjusted, after which the mortar composition is cured.

The typical structure of a dispensing apparatus of this kind has dispensing pistons which are arranged on push rods and move in the direction of the output opening of the cartridge. The push rods are driven by a feed mechanism.

In order to ensure error-free operation, it is necessary for the cartridge device used in each case to be matched to the dispensing apparatus. If combinations of the cartridge device and dispensing apparatus are used that do not match, this can cause damage to both the cartridge device and the dispensing apparatus. Moreover, when using non-matched combinations, it is possible for an applied cured composition to not have the desired mechanical properties to the desired extent after curing.

SUMMARY OF THE INVENTION

The problem addressed by the invention is that of providing a method for operating a dispensing system and a dispensing system for carrying out a method of this kind, by means of which damage and/or malfunction of the inserted cartridge device and/or the dispensing apparatus used can be reliably prevented in a structurally simple and safe manner.

This problem is solved by means of a method for operating a dispensing system comprising a dispensing apparatus and a cartridge device, the dispensing apparatus comprising at least one receiving chamber for receiving the cartridge device, at least one dispensing device, a control device, a drive device and a power supply, by the method comprising the following steps:

- inserting the cartridge device into the at least one receiving chamber;
- emitting at least one first signal from a signal generator of the cartridge device;
- receiving the at least one signal of the cartridge by means of at least one sensor of the dispensing apparatus;
- transmitting a second signal from the sensor to the control device;
- transferring the drive device from a first operating mode into a second operating mode if the second signal corresponds to a value stored in the control device or if an algorithm stored in the control device verifies the second signal, or
- otherwise transferring the drive device into a third operating mode.

By means of the method according to the invention it is possible to easily detect whether a compatible dispensing system is present and whether the inserted cartridge device is suitable for use in the dispensing apparatus. If a compatible combination is detected, the drive device is transferred into normal or regular operation in the second operating mode, and if a non-compatible combination is detected, the drive device is transferred into the third operating mode. Risk of damage both to the cartridge device and to the dispensing apparatus can thereby be reduced or prevented in a simple, reliable and safe manner. Furthermore, if necessary, the effects of a users misconduct on the functionality of the cartridge device and/or the dispensing apparatus can be reduced or prevented if, for example, faulty insertion of the cartridge device into the receiving chamber is detected. In addition, as a result of the exchange of information between the cartridge device and the dispensing apparatus it is possible to optimize a dispensing process with regards to the cartridge device used in each case.

In a preferred embodiment, the first operating mode of the drive device is a deactivation mode in which no current is fed from the power supply to the drive device or a coupling of the drive mechanism is released. In so doing, in a basic state of the dispensing system, a potentially undesired actuation of the drive device is reliably prevented as a result of decoupling from the drive device.

Damage to the dispensing system can be prevented particularly reliably when the third operating mode of the drive device corresponds to the first operating mode of the drive device and the drive device in the third operating mode is in particular in a deactivation mode in which the drive device is preferably decoupled from the power supply.

In a preferred embodiment, the drive device easily remains in the first operating mode by means of interrupting the energy path between the power supply and the drive device.

In order to keep the risk of damage both to the cartridge device and to the dispensing apparatus as low as possible, it is possible, in the third operating mode of the drive device, for the drive device to be subjected to a feed motion in a first direction at a first speed which is slower than a speed of the feed motion of the dispensing device in the first direction in the second operating mode of the drive device.

At least one third signal can be emitted from the signal generator of the cartridge device, which third signal sets the drive device into the first operating mode, i.e. the drive device remains in or is placed into the first operating mode if the third signal exceeds a threshold value stored in the control device or is outside a predetermined range. As a result, for example, a displacement of the dispensing piston in the event of a user request can be easily prevented when an expiry date of the cartridge device or a best-before date of a perishable chemical stored in the cartridge device is exceeded or a permissible temperature range stored on the cartridge device is not present. In so doing it is possible to ensure, for example, that the material in the cartridge device has the desired mechanical properties to the full extent after application and curing.

In an advantageous embodiment, a warning signal is emitted by a warning signal generator in the third operating mode of the drive device. The user can hereby be informed, for example in an acoustic, visual or haptic manner, if a cartridge device that is not compatible with the dispensing apparatus is present, for example.

Also or in addition thereto, a warning signal of this kind can be emitted by a warning signal generator if the third signal exceeds a threshold value stored in the control device.

A dispensing system for carrying out a method described in greater detail above is also proposed, which system comprises a dispensing apparatus and a cartridge device, the dispensing apparatus comprising at least one receiving chamber for receiving the cartridge device, at least one dispensing device for exerting a force onto the cartridge device, a control device, a drive device and a power supply.

By means of the dispensing system according to the invention it is possible to easily detect whether a cartridge device is suitable for use in the dispensing apparatus. Risk of damage both to the cartridge device and to the dispensing apparatus can thereby be reduced or prevented in a simple, reliable and safe manner. Furthermore, if necessary, the effects of a user's misconduct on the functionality of the cartridge device and/or the dispensing apparatus can be reduced or prevented.

The cartridge device can be designed so as to have one chamber or cartridge or so as to have two or more chambers or cartridges, with different materials being arranged in particular in each cartridge if the cartridge device has a plurality of cartridges. The receiving chamber of the dispensing apparatus is in this case designed to receive the in particular cylindrical cartridge of the cartridge device. It is possible, for example, for the cartridge device to comprise a two-component mortar composition, a curable resin component being arranged in one cartridge of the cartridge device and a curing component being arranged in a further chamber of the same cartridge device, which further chamber is arranged separately from the first cartridge in a reaction-inhibiting manner.

In order to implement signal transmission between the cartridge device and the dispensing apparatus in a structurally simple manner, a wireless transmission device can be provided which comprises a signal generator associated with the cartridge device and at least one sensor associated with the dispensing apparatus. Signal transmission from the cartridge device to the dispensing apparatus is possible by means of the transmission device and, as a result, a dispensing process can be optimized with regards to the cartridge device used in each case.

In an advantageous embodiment, the wireless transmission device is an optical transmission device or a radio transmission device. The transmission device can in this case be based on different operating principles and/or standards. The operating principle of the transmission device can be based on signal transmission in the radio frequency range, for example by means of ultra-short wave, short wave or medium wave, or on signal transmission in the infrared or optical frequency range. In particular, the transmission device is designed as an RFID transmission device, as a Bluetooth transmission device, as an NFC transmission device, as a WiFi transmission device, as a QR transmission device or as a DMC transmission device. The transmission device can also be designed as a WLAN transmission device, as a ZigBee transmission device, as a Wibree transmission device, as a WiMAX transmission device, as an IrDA transmission device or as a transmission device which operates in accordance with optical directional radio.

In a development of the invention that is simple to implement, the signal emitted by the cartridge device and received by the at least one sensor is transmitted to the control device by the at least one sensor being connected to the control device via a further transmission device, the further transmission device being wired or wireless.

The further transmission device can in principle be designed to be comparable to the transmission device and be designed, for example, as an RFID transmission device, as a Bluetooth transmission device, as an NFC transmission device, as a WiFi transmission device, as a QR transmission device or as a DMC transmission device. The transmission device can also be designed as a WLAN transmission device, as a ZigBee transmission device, as a Wibree transmission device, as a WiMAX transmission device, as an IrDA transmission device or as a transmission device which operates in accordance with optical directional radio.

In order to be able to achieve interaction with a user in a structurally simple manner, in one preferred embodiment an output device is provided or arranged on a housing of the dispensing apparatus. The output device can be designed, for example, as a warning device which is designed to output optical, acoustic and/or haptic signals. In this case, the output device may comprise, for example, a display device, preferably in the form of a display, arranged on the dispensing apparatus. Alternatively or in addition, the output device can be part of a transmission device which is designed, for example, to wirelessly connect to a separate display device, for example a mobile radio device or a smartphone.

In an advantageous embodiment, the dispensing apparatus has at least one readable storage device which is designed to at least temporarily store the first signal, the second signal and/or the third signal. The storage device can preferably be read out via an output device, such that data stored on the storage device can be evaluated.

The dispensing apparatus of the dispensing system can in particular be mains-powered or battery-powered, depending on the application.

Further advantages can be found in the following description of the drawings. An embodiment of the present invention is shown in the drawings. The drawings, the description and the embodiments contain numerous features in combination. A person skilled in the art will expediently also con-sider the features individually and combine them to form meaningful further combinations.

In the drawings, identical and equivalent components are provided with the same reference signs.

DETAILED DESCRIPTION OF THE INVENTION

Figure 1:
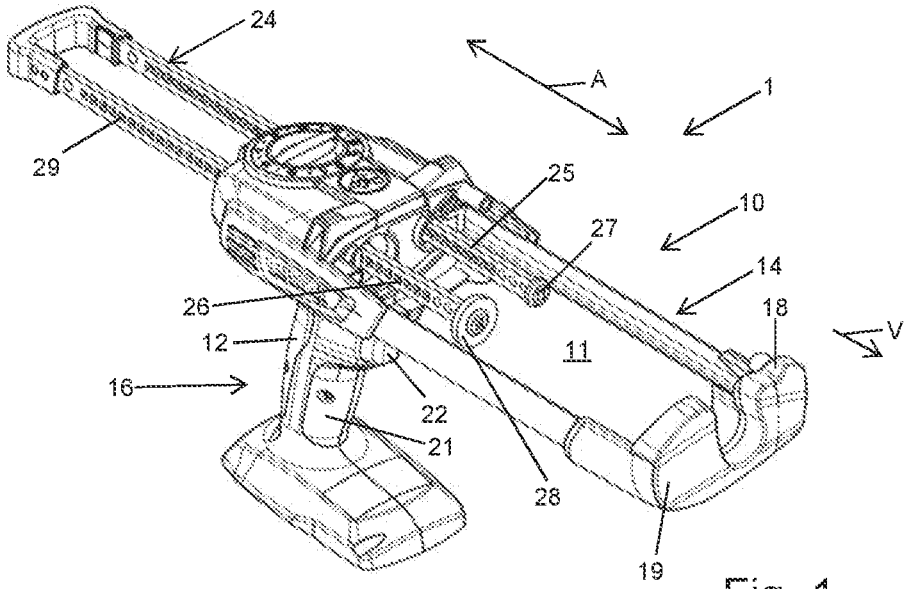
FIG. 1 is a simplified three-dimensional view of a dispensing apparatus of a dispensing system.
Figure 2:
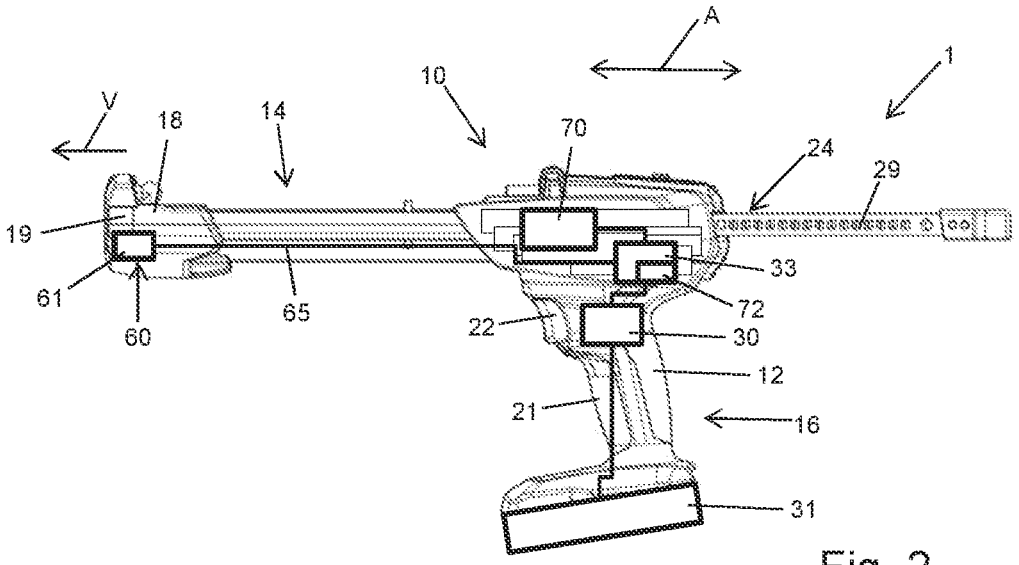
FIG. 2 is a simplified side view of the dispensing apparatus of the dispensing system according to FIG. 1.

A preferred embodiment of a dispensing system 1 according to the invention is shown in FIG. 1 and FIG. 2, a dispensing apparatus 10 of the dispensing system 1 being shown in FIG. 1 and a cartridge device 40 of the dispensing system 1 being shown in FIG. 2.

The dispensing apparatus 10 can in principle be designed to dispense single-component and, in the present case, in particular multi-component compositions, and the compositions can be provided for filling, gluing or sealing or similar applications in the construction sector, for example. These and other compositions are arranged in one or more cartridges of a cartridge device.

Figure 3:
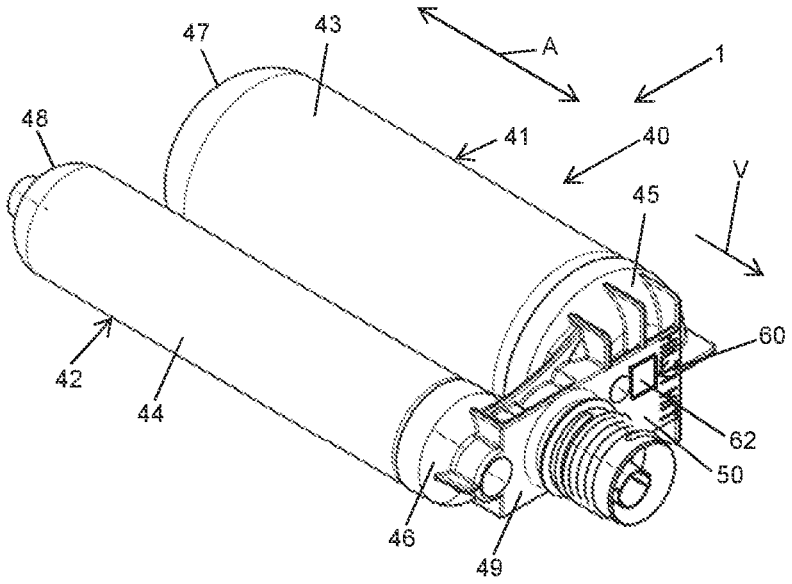
FIG. 3 is a three-dimensional view of a cartridge device of the dispensing system, which cartridge device is designed to interact with the dispensing apparatus according to FIG. 1 and FIG. 2.

In the present case, the dispensing apparatus 10 is designed to interact with a cartridge device 40 shown in FIG. 3 that has two containers designed as cartridges 41 and 42. The cartridge device 40 can be arranged in a receiving chamber 11 of a housing 12 of the dispensing apparatus 10 and can contain, for example, a two-component mortar composition. In this case, a curable resin component can be arranged in one chamber or cartridge 41 of the cartridge device 40, and a curing component can be arranged in the other chamber or cartridge 42 of the cartridge device 40 that is arranged separately from the first chamber or cartridge in a reaction-inhibiting manner. The composition produced after mixing the curable resin component and the curing component is used, for example, as an injection mortar for the chemical anchoring, for example, of metal elements in mineral substances, in particular structures made of brickwork, concrete or natural stone. In this case, the boreholes which are correspondingly required for fastening the anchoring means are first introduced into the mineral substrate, after which the curable resin component is mixed with the curing component of the two-component mortar composition and introduced into the borehole, whereupon the anchoring means to be fastened is inserted and adjusted, and the mortar composition is subsequently cured.

In the present case, the housing 12 of the dispensing apparatus 10 extends substantially along an axial direction A and has a functional portion 14 and a handling portion 16. The functional portion 14 substantially comprises the receiving chamber 11 and, at a processing-side distal end 18 of the functional portion 14, a processing head 19 into which a dispensing opening of the cartridges 41, 42 extends. Compositions output from the cartridges 41, 42 are mixed in particular in a mixing region 49 of the cartridge device 40 and output, at the processing-side distal end 18 of the functional portion 14, to a location which is to be processed.

In addition to a handle 21, the handling portion 16 of the housing 12 comprises an actuation switch 22 which is arranged in the region of the handle 21 and can be designed, for example, as a so-called MOSFET switch. In order to dispense out of the cartridges 41, 42, a dispensing device 24 is provided which in the present case is designed so as to have two dispensing pistons 25, 26 which in the present case are rigidly interconnected via a push rod 29. Each dispensing piston 25, 26 comprises a stamp 27 or 28 at the end thereof facing the relevant cartridge 41 or 42, respectively.

Furthermore, a drive device is provided which is only shown schematically here and is in particular designed as an electric motor 30, by means of which device the dispensing pistons 25, 26 can be displaced in the axial direction A. Alternatively, the dispensing pistons 25, 26 can also be operated by means of compressed air or by means of a hydraulic drive.

In order to convey compositions in the cartridges 41, 42 out of the cartridges 41, 42 via the dispensing openings, the dispensing pistons 25, 26 can be moved together in the direction of the distal end 18 by means of the push rod 29 that can be driven by the electric motor 30 in a feed direction V.

In the present case, the electric motor 30 is supplied with energy by a power supply which is only shown schematically in FIG. 2 and is designed as an accumulator 31. Alternatively, the dispensing apparatus 10 may also be mains-powered, it being possible for a plug which can be coupled to a mains supply to be provided. The dispensing apparatus 10 also comprises a control device 33 which is designed to actuate the electric motor 30 according to a user request by means of the actuation switch 22.

The electric motor 30 can be put into different operating modes by the control device 33, a first operating mode corresponding to a deactivation mode in which no current is fed from the accumulator 31 to the electric motor 30 and an actuation of the actuation switch 22 does not lead to a displacement of the push rod 29. A second operating mode corresponds to normal or regular operation of the electric motor 30, in which a user's actuation of the actuation switch 22 leads to a displacement of the dispensing pistons 25 and 26 in the feed direction V at a first speed. The electric motor 30 can in particular also be set into a third operating mode by the control device 33, in which mode a user's actuation of the actuation switch 22 leads to a displacement of the dispensing pistons 25 and 26 in the feed direction V at a second speed which is reduced relative to the first speed.

In the present case, the cartridges 41, 42 of the cartridge device 40 each have a substantially cylindrical main body 43 or 44 comprising a first end wall 45 or 46 and an opposite second end wall 47 or 48, respectively. An output opening is provided at each first end wall 45 or 46, which openings are interconnected via the mixing region 49. For example, an output device in the form of a spout can be connected to the mixing region 49. The second end wall 47 or 48 is designed to interact with the stamp 27 or 28 of the relevant dispensing piston 25 or 26, respectively, a volume of the main body 43 or 44 of the relevant cartridge 41 or 42 being reduced when the dispensing piston 25 or 26 is displaced in the feed direction V in the direction of the first end wall 45 or 46 such that the relevant composition is conveyed into the cartridges 41 and 42 through the output opening, mixed together in the mixing region 49 and dispensed out via the output device.

The dispensing system 1 also has a transmission device 60 which has at least one sensor 61 arranged on the dispensing apparatus 10 and a signal generator 62 arranged on the cartridge device 40. The transmission device 60 is wireless and can operate by means of various transmission principles. In particular, said transmission device is an RFID transmission device, but may alternatively also be designed, for example, as a Bluetooth transmission device, an NFC transmission device, a WiFi transmission device, a QR transmission device, a DMC transmission device, a WLAN transmission device, a ZigBee transmission device, a Wibree transmission device, a WiMAX transmission device, an IrDA transmission device or a transmission device which operates in accordance with optical directional radio.

In the present case, the signal generator 62 is arranged on an end face 50 of the mixing region 49 of the cartridge device 40 whereas the sensor 61 is arranged on the housing 12 of the dispensing apparatus 10 such that, when the cartridge device 40 is arranged in the receiving chamber 11 in a prescribed manner, the signal generator 62 of the cartridge device 40 interacts with the sensor 61 and signals can be transmitted from the signal generator 62 to the sensor 61. For this purpose, the sensor 61 is arranged, for example, in the region of a wall of the housing 12 that defines a distal end region of the receiving region 11.

The sensor 61 is coupled to the control device 33 by means of a further transmission device 65, it being possible for the further transmission device 65 to be wireless or wired. The further transmission device 65 can be designed on the basis of the same transmission mechanisms as the transmission device 60.

Figure 4:
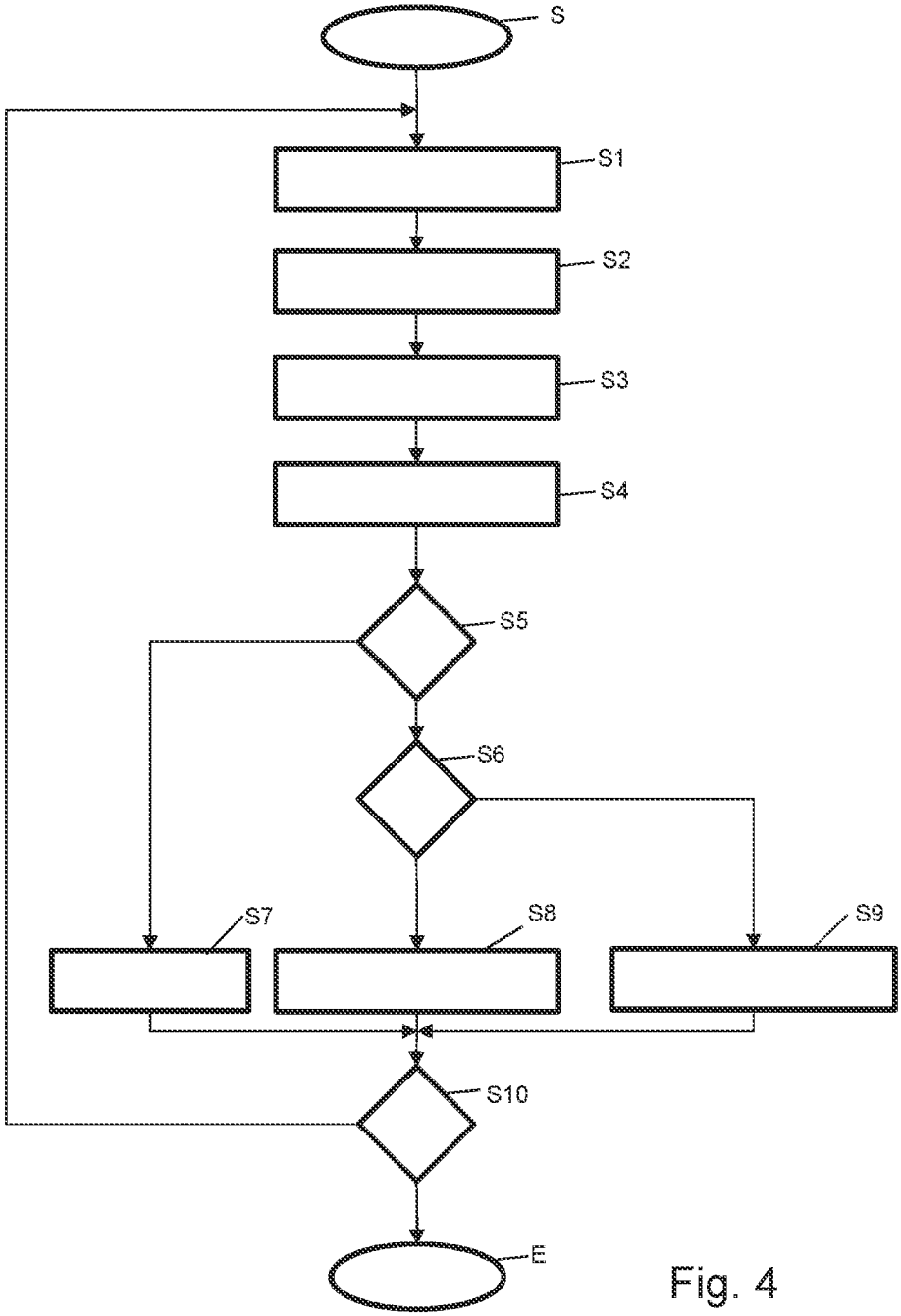
FIG. 4 is a simplified view of a flow chart of an embodiment of a method according to the invention for operating the dispensing system according to FIGS. 1 to 3.

FIG. 4 shows an embodiment of a method according to the invention for operating the dispensing system 1, it being possible by means of the method to determine, for example, whether a compatible system consisting of a dispensing apparatus 10 and a cartridge device 40 is present. As a result, damage both to the dispensing apparatus 10 and to the cartridge device 40 can be reliably prevented. The risk of damage as a result of incorrect operation can also be reduced or prevented, for example.

The method begins at the start S. In step S1, the cartridge device 40 is inserted into the receiving chamber 11. In step S2, the signal generator 62 of the cartridge device 40 emits a first signal which in particular identifies the cartridge device 40 in terms of type, size, shape and the like. In addition, in the present case, the cartridge device 40 additionally emits a third signal which contains, for example, a best-before date of the cartridge device 40, a permissible temperature range of the surrounding region for processing or the like. The signals emitted by the cartridge device 40 are received by the sensor 61 of the dispensing apparatus 10 in step S3 when the cartridge device 40 is arranged in the receiving chamber 11 in a prescribed manner.

Subsequently, in step S4, a second signal which corresponds to the first signal and the third signal or is generated from the first signal and the third signal is transmitted from the sensor 61 to the control device 33. In query step S5, the second signal that correlates to the third signal is compared, for example, with a current ambient temperature determined by a temperature sensor and, if the current ambient temperature lies within a permissible temperature range for the cartridge device 40, the method proceeds to query step S6. Alternatively or in addition, the query step S5 can compare whether the current date is before the permissible best-before date of the cartridge device 40. If the result is positive, the method proceeds to query step S6.

If the query result in query step S5 is negative, the electric motor 30 is set into the first operating mode by the control device 33 in step S7, i.e. the electric motor 30 remains in the first operating mode if it was already in said mode, or the electric motor 30 is transferred into the first operating mode if it was previously in another operating mode. In the first operating mode of the electric motor 30, an actuation of the actuation switch 22 does not lead to a displacement of the push rod 29 and thus of the dispensing pistons 25 and 26.

Following a positive query result in query step S5, in query step S6 the second signal that correlates to the first signal is compared with values stored in the control device 33, for example in the form of a look-up table, or verified by means of an algorithm stored in the control device 33. If the result of the comparison or the verification is positive, the electric motor 30 is transferred into the second operating mode by the control device 33 in step S8, whereas if the query result in the query step S6 is negative, the electric motor 30 is transferred into the third operating mode in step S9. Alternatively, the electric motor 30 can also be transferred into the first operating mode in step S9. In the second operating mode of the electric motor 30, a user request caused by actuating the actuation switch 22 leads to a displacement of the push rod 29 and thus to the displacement of the dispensing pistons 25, 26.

In the query step S10 which follows steps S7, S8 and S9, a query is made as to whether relevant framework conditions to be defined have changed to a predetermined extent. If the query result is positive, the method is resumed at step S1. If the query result is negative, the method is stopped at step E.

By means of the method for operating the dispensing system 1, damage both to the dispensing apparatus 10 and to the cartridge device 40, which damage could occur, for example, as a result of using a cartridge device 40 which is incompatible with the dispensing apparatus 10, can be easily prevented. Furthermore, by transmitting corresponding data from the cartridge device 40 to the dispensing apparatus 10, it is possible to easily prevent the cartridge device 40 from being used in the event of correspondingly definable impermissible framework conditions which can lead to undesired processing results. Damage to the cartridge device 40 and/or the dispensing apparatus 10 that is caused by a cartridge device 40 being arranged incorrectly in the receiving chamber is also prevented from occurring when the signal generator 62 and the sensor 61 are designed and arranged such that signal transmission between the signal generator 62 and the sensor 61 only takes place when the cartridge device 40 is arranged in the receiving chamber 11 to a prescribed extent.

The dispensing apparatus 10 comprises in particular an output device 70 which is designed, for example, to output a warning signal in an optical, acoustic and/or haptic manner when the electric motor 30 is set into the first operating mode by the control device 33 in step S7 and/or transferred into the third operating mode in step S9. The control device 33 can also have a storage device 72 which is designed to at least temporarily store the first signal, the second signal and/or the third signal and which can be read out via an output device. As a result, utilization information of the dispensing system 1 can be easily evaluated.

LIST OF REFERENCE SIGNS

1 dispensing system
10 dispensing apparatus
11 receiving chamber
12 housing
14 functional portion
16 handling portion
18 distal end
19 processing head
21 handle
22 actuation switch
24 dispensing device
25 dispensing piston
26 dispensing piston
27 stamp
28 stamp
29 push rod

30 drive device; electric motor
31 power supply; accumulator
33 control device
40 cartridge device
41 first cartridge
42 second cartridge
43 main body
44 main body
45 first end wall
46 first end wall
47 second end wall
48 second end wall
49 mixing region
50 end face
60 transmission device
61 sensor
62 signal generator
65 further transmission device
70 output device
72 storage device
A axial direction
V feed direction

The invention claimed is:

1. A method for operating a dispensing system, comprising a dispensing apparatus and a cartridge device, the dispensing apparatus comprising at least one receiving chamber for receiving the cartridge device, at least one dispensing device, a control device, a drive device and a power supply, said method comprising:

inserting the cartridge device into the at least one receiving chamber;

emitting at least one first signal from a signal generator of the cartridge device;

receiving the at least one signal of the cartridge device by at least one sensor of the dispensing apparatus;

transmitting a second signal from the sensor to the control device;

transferring the drive device from a first operating mode into a second operating mode if the second signal corresponds to a value stored in the control device or if an algorithm stored in the control device verifies the second signal;

or transferring the drive device into a third operating mode wherein the first operating mode of the drive device is a deactivation mode in which no current is fed from the power supply to the drive device.

2. The method according to claim 1, wherein the third operating mode of the drive device corresponds to the first operating mode of the drive device.

3. The method according to claim 2, wherein the drive device remains in the first operating mode by means of interrupting the energy path between the power supply and the drive device.

4. The method according to claim 1, wherein, in the third operating mode of the drive device, the dispensing device is subjected to a feed motion in a first direction at a first speed which is slower than a speed of the feed motion of the dispensing device in the first direction in the second operating mode of the drive device.

5. The method according to claim 1, comprising: emitting at least one third signal from the signal generator of the cartridge device, which third signal sets the drive device into the first operating mode if the third signal is greater than a threshold value stored in the control device.

6. The method according to claim 5, comprising: emitting a warning signal by a warning signal generator in the third operating mode of the drive device.

7. The method according to claim 6, comprising: emitting a warning signal by a warning signal generator if the third signal exceeds a threshold value stored in the control device.

8. A dispensing system for carrying out a method according to claim 1, comprising:

a dispensing apparatus, and a cartridge device, wherein the dispensing apparatus comprises at least one receiving chamber for receiving the cartridge device, at least one dispensing device, a control device, a drive device, and a power supply wherein said dispensing, apparatus is in a first operating mode whereby an energy path between said power supply and said the drive device is interrupted.

9. The dispensing system according to claim 8, wherein a wireless transmission device is provided which comprises a signal generator associated with the cartridge device and at least one sensor associated with the dispensing device.

10. The dispensing system according to claim 9, wherein the wireless transmission device is an optical transmission device or a radio transmission device and is in particular designed as an RFID transmission device, as a Bluetooth transmission device, as an NFC transmission device, as a WiFi transmission device, as a QR transmission device, as a DMC transmission device, as a WLAN transmission device, as a ZigBee transmission device, as a Wibree transmission device, as a WiMAX transmission device, as an IrDA transmission device or as a transmission device which operates in accordance with optical directional radio.

11. The dispensing system according to claim 9, wherein the at least one sensor is connected to the control device by a further transmission device, the further transmission device being wired or wireless.

12. The dispensing system according to claim 11, wherein the further transmission device is designed as an RFID transmission device, as a Bluetooth transmission device, as an NFC transmission device, as a WiFi transmission device, as a QR transmission device, as a DMC transmission device, as a WLAN transmission device, as a ZigBee transmission device, as a Wibree transmission device, as a WiMAX transmission device, as an IrDA transmission device or as a transmission device which operates in accordance with optical directional radio.

13. The dispensing system according to claim 8, wherein an output device is provided on a housing of the dispensing apparatus.

14. The dispensing system according to claim 8, wherein the dispensing apparatus has at least one readable storage device which is designed to at least temporarily store the first signal, the second signal and/or the third signal.

15. The method according to claim 1, wherein said cartridge device comprises a component of a two-component mortar composition.

16. The method according to claim 15, wherein said cartridge device comprises a first chamber comprising a curable resin component and a second chamber comprising a curing component.

17. The method according to claim 1, wherein in said second operating mode, it is possible to dispense material from said cartridge device.

* * * * *